United States Patent [19]

Koike

[11] Patent Number: 4,757,491

[45] Date of Patent: Jul. 12, 1988

[54] SOUND GENERATING TOY

[75] Inventor: Eishi Koike, Sagamihara, Japan

[73] Assignee: Ozen Corporation, Tokyo, Japan

[21] Appl. No.: 923,436

[22] Filed: Oct. 27, 1986

[30] Foreign Application Priority Data

Jan. 31, 1986 [JP] Japan ..... 61-13049[U]

[51] Int. Cl.[4] ..... A63H 3/33; G01L 9/04; G11B 19/00; G11B 31/00

[52] U.S. Cl. ..... 369/63; 250/221; 446/175; 446/302

[58] Field of Search ..... 369/63; 250/221; 446/302, 297, 175

[56] References Cited

U.S. PATENT DOCUMENTS

| | | | |
|---|---|---|---|
| 3,588,118 | 6/1971 | Pipa | 369/63 |
| 3,621,356 | 11/1971 | On | 446/175 |
| 4,591,709 | 5/1986 | Koechner | 250/221 |
| 4,637,007 | 1/1987 | Sakurai | 369/63 |
| 4,659,919 | 4/1987 | Price | 446/175 |

*Primary Examiner*—Steven L. Stephan
*Attorney, Agent, or Firm*—Arnold Weintraub

[57] ABSTRACT

A pair of photoconductive elements are provided on an inner surface of a light transmitting outer skin of a doll. When the amount of light impinging on either one of the pair of photoconductive elements differs from the other as a result of interruption of the light impinging on the one of the photoconductive elements, a sound generating device is actuated to generate a sound.

1 Claim, 2 Drawing Sheets

SOUND GENERATING TOY

BACKGROUND OF THE INVENTION

1. Field of the Invention:

The present invention relates to a sound generating toy, and in particular, to such a toy in which a sound generating device provided therein is operated by detecting the interruption of light impinging on the sound generating toy by a face, hand, or the like of a toy operator.

2. Description of the Prior Art:

A prior art sound generating toy is disclosed, for example, in Japanese Utility Model Laid-Open (Kokai) Publication No. 60-49894 (1985).

In this prior art toy, a sound generating device of the toy is designed to be operated by sensing a sound. For this purpose, a melody generating mechanism having a sound sensitive actuating switch is provided in the toy body as the sound generating device. The sound sensitive actuating switch is composed of a microphone, an amplifier, and a switching circuit which turns on the melody generating mechanism in response to a sound sensed signal from the amplifier. The melody generating mechanism starts its operation upon receiving an ON signal from the switching circuit and finishes the operation after the lapse of a fixed time period.

However, since the prior art sound generating toy is designed to operate the sound generating device by sensing a sound, there are problems in that it is impossible to distinguish extraneous sounds, such as, for example, a sound made by opening or shutting a door, sound made when an object falls to the floor, etc. Hence, the sound generating device is caused to operate erroneously by the extraneous sounds, and it is impossible to operate the sound generating device only when the operation thereof is intended by the toy operator.

SUMMARY OF THE INVENTION

The present invention was made in view of the problems in the prior art. It is an object of the present invention to provide a sound generating toy in which a pair of photodetecting elements are provided on an inner surface of a light transmitting outer skin of the toy. The sound generating toy, which operates only when a toy operator intends it to, determines whether the amounts of light received respectively by the pair of photodetecting elements are balanced or coincident with each other. Thus, the toy is novel and interesting.

In order to achieve the above objects, a sound generating toy in accordance with the present invention comprises: a pair of photodetecting elements disposed with a predetermined interval therebetween on an inner surface of a light transmitting outer skin; a relative change detecting circuit for producing a detection signal indicative of the occurrence of a relative change between two detection signals from the pair of photodetecting elements when a relative change is detected; and a driving circuit responsive to the detection signal from the relative change detecting circuit for driving a sound generating device.

In the present invention, for a condition wherein the amounts of light impinging on the pair of photodetecting elements are substantially equal, a detection signal is not obtained from the relative change detecting circuit, and an inoperative condition of the sound generating device is maintained. From this inoperative condition, the toy may be activated if the amount of light impinging on one of the photodetecting elements is reduced by covering it with a face, hand, etc., of the toy operator. This reduction of the amount of light is detected by the relative change detecting circuit and a detection signals is outputted. When a driving signal for the sound generating device is outputted from the driving circuit in response to the detection signal, the sound generating circuit is operated, and a predetermined sound is generated.

In the present invention, since the sound generating device generates a predetermined sound upon detection of a change in the balance of the amounts of light impinging on both the photodetecting elements by a relative change detecting circuit only when the light impinging on one of the photodetecting elements is interrupted, no erroneous operation is caused due to a change in the amount of external light so long as the amounts of light impinging on both the photodetecting elements are equal. A sound can be generated reliably only when the toy operator intends it. Furthermore, since the generation of the sound is effected by reducing the amount of light to one of the photodetecting elements, the toy is more interesting to the operator.

DESCRIPTION OF THE PREFERRED EMBODIMENT

Figure 1:
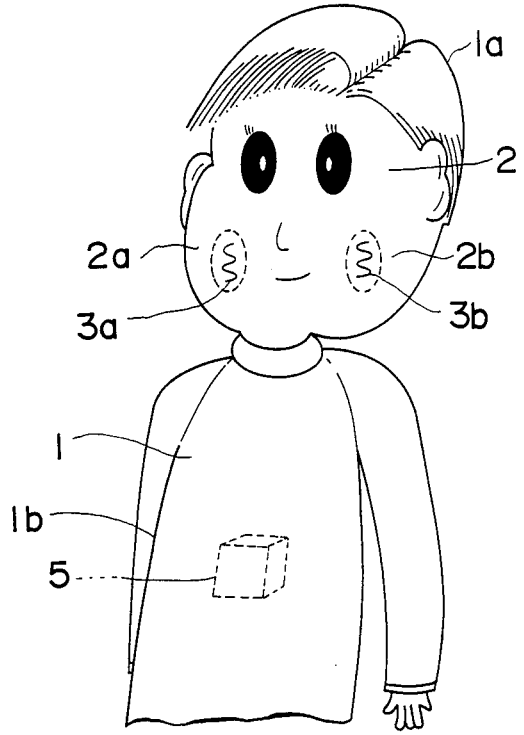
FIG. 1 is a schematic perspective view of an embodiment of the present invention.

In FIG. 1, a doll 1 has a face portion 1*a* covered with a light transmitting outer skin 2. On inner surface of the outer skin 2 at positions corresponding to both cheeks 2*a* and 2*b*, there are provided photoconductive elements 3*a* and 3*b* of CdS, or the like.

Figure 2:
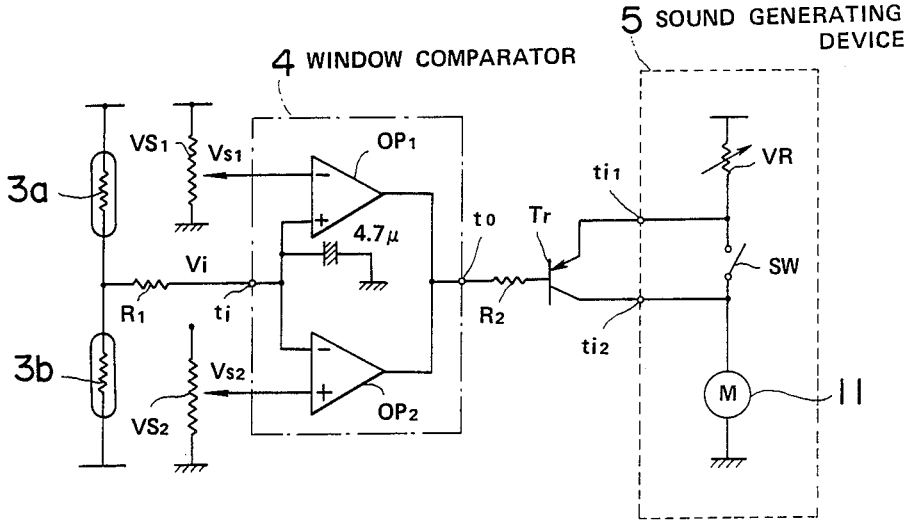
FIG. 2 is a circuit diagram of an example of a control device applicable in the present invention.

The photoconductive elements 3*a* and 3*b* are connected in series, as shown in FIG. 2, between predetermined power supply lines. A voltage dividing point between the elements 3*a*, 3*b* is connected through a resistor $R_1$ to an input terminal $t_i$ of a window comparator 4.

The window comparator 4 includes two operational amplifiers $OP_1$ and $OP_2$ as shown in FIG. 2. A positive input side of the operational amplifier $OP_1$ and a negative input side of the operational amplifier $OP_2$ are connected to each other, and the junction point thereof is connected to the input terminal $t_i$. A negative input side of the operational amplifier $OP_1$ and a positive input side of the operational amplifier $OP_2$ are respectively connected to voltage setting resistors $VS_1$ and $VS_2$. The voltage setting resistors $VS_1$ and $VS_2$ are variable resistors. A voltage $V_{S1}$ having a value smaller by a predetermined value $\Delta V$ than a divided voltage $V_i$ obtained when resistance values of the photoconductive elements 3*a* and 3*b* are substantially equal is set in the voltage setting resistor $VS_1$. A voltage $V_{S2}$ having a value larger than the divided voltage $V_i$ by the predetermined value $\Delta V$ is set in the voltage setting resistor $VS_2$. Further, output sides of the operational amplifiers $OP_1$ and $OP_2$ are connected to each other, and the junction point thereof is connected to an output terminal $t_o$ of the window comparator 4. As a result, when $V_i < V_{S1}$, the output side of the operational amplifier $OP_1$ goes to a low level, and the output side of the operational amplifier $OP_2$ goes to a high level. When $V_{S1} \leqq V_i \leqq V_{S2}$, the output sides of both the operational amplifiers $OP_1$ and $OP_2$ go to the high level. When $V_1 > V_{S1}$, the output side of the operational amplifier $OP_2$ goes to the low level and the output side of the operational amplifier $OP_1$ goes to the high level.

The output terminal $t_o$ of the window comparator 4 is connected through a resistor $R_2$ to a base of a PNP type transistor Tr which constitutes a driving circuit. An emitter and a collector of the transistor Tr are respectively connected to input terminals $t_{i1}$ and $t_{i2}$ of a sound generating device 5.

Figure 3:
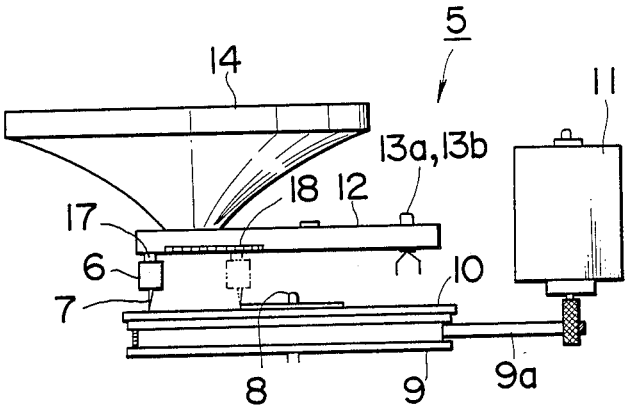
FIG. 3 is a front view of an example of a sound generating device applicable in the present invention.
Figure 4:
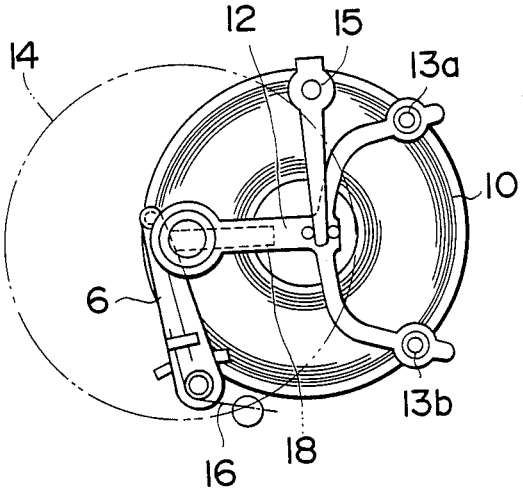
FIG. 4 is a plan view of the sound generating device with a part thereof omitted.

The sound generating device 5 is accommodated in a trunk 1*b* of the doll 1, and is structured as shown in FIGS. 3 and 4. Specifically, the reference numeral 6 designates a tone arm pivoted at a case (not shown) which has a reproducing stylus 7 at its tip. The tone arm 6 and the reproducing stylus 7 constitute a pickup. the reproducing stylus 7 engages a recorded groove of a recorded disk 10 having a predetermined sound signal, for example, a laughing voice recorded thereon. A recorded disk 10 is placed on a turn table 9 which is pivoted at a center pin 8 fixed to the casing. The tip of the tone art 6 turns and moves to a position shown by the phantom lines in FIG. 3 due to rotation of the recorded disk 10. In this case, the turn table 9 is coupled with a rotating shaft of a driving motor 11 through a belt 9*a*, and it is driven into rotation by the rotation of the driving motor 11.

On the tone ar 6 there is provided a sound conducting member 12 extending along a locus on which the tip of the tone art 6 is turned and moved. The sound conducting member 12 is, as shown in FIG. 4, formed in a Y-shape. Both ends of the forked legs of the Y are hung on holding shafts 13*a* and 13*b* secured to the casing. The free end of the sound conducting member 12 is supported by the tone arm 6 to maintain the sound conducting member 12 substantially horizontal. A speaker diaphragm 14 is directly carried on the free end of the sound conducting member 12. Consequently, the tone arm 6 is sandwiched between the recorded disk 10 and the sound conducting member 12, and in this condition, the reproducing stylus 7 engages the recorded groove of the recorded disk 10. A leaf spring 15 is provided to press the sound conducting member 12 downwardly to adjust the stylus pressure.

Further, the tone art 6 is, as shown in FIG. 4, normally urged by a turn spring 16 at the pivot point towards a reproduction starting point on the peripheral portion of the recorded disk 10. Thus, the turning movement of the end of the tone arm 6 caused by the rotation of the turn table 9 is effective against the urging force of the turn spring 16.

When the end of the tone arm 6 reaches a reproduction ending point on an inner circular portion of the recorded disk 10 shown by the phantom lines in FIG. 3, the tone art 6 is designed to be moved upwardly to disengage the reproducing stylus 7 from the recorded groove of the recorded disk 10 as is known in the art. It automatically returns to the reproduction starting point by the turning force of the turn spring 15.

Furthermore, on the lower surface of the sound conducting member 12, there is provided an electrical conductive member 18 with which a slider 17 formed on the upper surface of the tone arm 6 is brought into contact when the tone arm 6 is moved slightly inwardly from the production starting point. This electrical conductive member 18 and the slider 17 constitute a self-holding switch SW (FIG. 2).

The driving motor 11 is supplied with DC power through a series circuit of a variable resistor VR and the self-holding switch SW. Both ends of the self-holding switch SW are respectively connected to the input terminals $t_{i1}$ and $t_{i2}$ of the sound generating device 5.

Next, the operation of the above-mentioned embodiment will be described. Supposing that substantially equal amounts of light are impinging on each of the photoconductive elements 3*a* and 3*b* when a head portion of the doll 1 is illuminated by light, resistance values of the photoconductive elements 3*a* and 3*a* when a head portion of the doll 1 is illuminated by light. Resistance values of the photoconductive elements 3*a* and 3*b* respectively assume values corresponding to the amount of light. Hence, the resistance values are substantially equal to each other. Consequently, the voltage $V_i$ at the voltage dividing point is equal to $\frac{1}{2}$ of the predetermined voltage applied across the photoconductive elements 3*a* and 3*b*. This voltage $V_i$ is inputted to the input terminal $t_i$ of the window comparator 4.

Accordingly, this input voltage $V_i$ is in the following relationship with respect to the set voltages $V_{S1}$ and $V_{S2}$ of the voltage setting resistors $VS_1$ and $VS_2$:

$$V_{S1} < V_i < V_{S2}.$$

Thus, the output side of each of the operational amplifiers $OP_1$ and $OP_2$ goes to a high level.

As a result, the transistor Tr is maintained in a turned-off condition and electric power is not supplied to the driving motor 11. Driving motor 11 is in a non-driving condition, turn tabke 9 is in a non-rotating condition, and no sound is outputted from the speaker diaphragm 14.

As mentioned in the foregoing, when the resistance values of the photoconductive elements 3*a* and 3*b* are substantially equal to each other, irrespective of the amount of light illuminating the face of the doll 1 including both the cheeks, the divided voltage is not changed. Accordingly, no erroneous operation occurs in any place at which the doll 1 is located, including an outdoor sunlit place or an illuminated indoor place.

If the toy operator approaches the doll 1 with his lip to one cheek 2*a* of the doll 1, the light impinging on the photoconducting element 3*a* is interrupted, resulting in an increase in the resistance value. Consequently, the divided voltage $V_i$ at the voltage dividing point is reduced. When the divided voltage $V_i$ becomes less than the set voltage $V_{S1}$, the output side of the operational amplifier $OP_1$ in the window comparator 4 is inverted from the high level to a low level. In response to this invention, the driving transistor Tr is turned on, and DC power is supplied through the variable resistor VR and the transistor Tr to the driving motor 11 to cause it to start rotation. Due to the rotation of the driving motor 11, the turn table 9 and recorded disk 10 thereon are rotated. As a result, a sound signal recorded on the recorded disk 10 is reproduced by the reproducing stylus 7 attached to the tone arm 6. The reproduced sound signal is conducted to the speaker diaphragm 14 through the sound conducting member 12, and the sound of laughing voice recorded on the recorded disk 10 beforehand is heard form the speaker diaphragm 14.

When the toy operator covers photoconductive element 3*b* with a light interrupting object, such as a lip, hand, or the like, the output side of the operation amplifier $OP_2$ in the window comparator 4 goes to a low level as the divided voltage $V_i$ exceeds the set voltage $V_{S2}$. The transistor Tr is turned on to cause the sound generating device 5 to generate a predetermined sound similar to the above case.

In the embodiment described in the foregoing, the photoconducting elements 3*a* and 3*b* are provided at the cheeks 2*a* and 2*b* of the doll 1. However, the present invention is not limited to this. The pair of photoconductive elements 3*a* and 3*b* may be provided at other portions of the doll 1. Further, the photodetecting element is not limited to a photoconductive element. Other light receiving elements may, of course, be used.

Further, as a sound generating device, the present invention is not limited to a sound generating device 5 employing a recorded disk 10. A magnetic reproducing device, a voice synthesizer circuit, or the like also may be used.

Further, in the embodiment described above, the sound generating device 5 is designed to generate a laughing voice. However, the present invention is not limited to this, and other arbitrary sounds may be generated.

Furthermore, the relative change detecting circuit is not limited to the window comparator. A coincidence detecting circuit for detecting a coincidence of both inputs may be applied. Alternatively, a photodetector for detecting the amount of light also may be provided to compare a detection signal therefrom with each of the photoconductive elements 3*a* and 3*b*.

I claim:

1. A sound generating toy comprising:

a pair of photoconductive elements having substantially equal resistance values under equal amounts of light impinging thereon and provided on an inner surface of a light transmitting outer skin of said toy for receiving light signals through the outer skin of said toy, said pair of photoconductive elements being spaced with a predetermined interval therebetween and connected in series between power supply lines to form a voltage dividing point between said pair of photoconductive elements;

a window comparator including first and second operational amplifiers for detecting a relative change between the resistance values of said pair of photoconductive elements caused by interruption of the light signal impinging on one of said pair of photoconductive elements by interposition of a light blocking objects, a positive input of said first operational amplifier and a negative input of said second operational amplifiers being connected commonly to said voltage divider point, a negative input of said first operational amplifier and a positive input of said second operational amplifier being connected respectively to first and second voltage setting resistors such that said first voltage setting resistor supplies a first set voltage S1 having a value smaller by a predetermined value than a voltage Vi at the voltage divider point and said second voltage setting resistor supplies a second set voltage $V_{S2}$ having a value larger by the predetermined value V than the voltage Vi at the voltage divider point, output terminals of said first and second operational amplifiers being connected commonly to an output terminal of said window comparator;

a sound generating device including a turn table driven by a motor and carrying a recorded disk having a sound signal recorded thereon, and a pickup having a reproducing stylus adapted to engage a recorded groove on said recorded disk; and a driving circuit connected to said output terminal of said window comparator to receive a detection indicative of the relative change between the resistance values of said pair of photoconductive elements, said driving circuit being turned on in response to said detection signal thereby to energize the motor of said sound generating device.

* * * * *